US011406144B2

(12) United States Patent
Kapila

(10) Patent No.: US 11,406,144 B2
(45) Date of Patent: Aug. 9, 2022

(54) SURGICAL FACE MASK GRIPPER TO IMPROVE PARTICULATE FILTERING EFFICIENCY

(71) Applicant: Anil Kapila, Sunnyvale, CA (US)

(72) Inventor: Anil Kapila, Sunnyvale, CA (US)

( * ) Notice: Subject to any disclaimer, the term of this patent is extended or adjusted under 35 U.S.C. 154(b) by 212 days.

(21) Appl. No.: 16/888,786

(22) Filed: May 31, 2020

(65) Prior Publication Data

US 2021/0360998 A1 Nov. 25, 2021

Related U.S. Application Data

(60) Provisional application No. 63/027,922, filed on May 20, 2020.

(51) Int. Cl.
*A41D 13/00* (2006.01)
*A41D 13/11* (2006.01)

(52) U.S. Cl.
CPC ..... *A41D 13/1146* (2013.01); *A41D 13/1161* (2013.01)

(58) Field of Classification Search
CPC ..... A41D 13/1161; A41D 13/1146; A41D 13/1138; A41D 13/11
See application file for complete search history.

(56) References Cited

U.S. PATENT DOCUMENTS 2,067,026 A * 1/1937 Schwartz ..... A41D 13/11 128/206.12
2,681,060 A * 6/1954 Swindell ..... A41D 13/1146 128/207.11
4,090,510 A * 5/1978 Segersten ..... A41D 13/11 128/206.12
6,102,039 A * 8/2000 Springett ..... A41D 13/1146 128/206.12

* cited by examiner

*Primary Examiner* — Steven O Douglas

(57) ABSTRACT

A surgical mask gripper covering nose apex, ala and mouth of a person is disclosed. Gripper is designed to enhance the flow of air through the mask filter and restrict the flow of air leaking through the periphery of the surgical face mask. Gripper covering the contours of nose apex and ala creates a tight seal between face skin and surgical mask. Low profile of gripper around nose allows a person to wear safety or eye glasses without any interference. Tight seal forces inhaled and exhaled air through the surgical mask filter thereby improving the particulate filtering efficiency and eliminate the fogging of safety glasses.

3 Claims, 2 Drawing Sheets

SURGICAL FACE MASK GRIPPER TO IMPROVE PARTICULATE FILTERING EFFICIENCY

CROSS REFERENCE TO RELATED APPLICATIONS

"Not Applicable"

STATEMENT OF FEDERALLY SPONSORED RESEARCH OR DEVELOPMENT

"Not Applicable"

THE NAMES OF THE PARTIES TO A JOINT RESEARCH AGREEMENT

"Not Applicable"

REFERENCE TO A "SEQUENCE LISTING,"

"Not Applicable"

BACKGROUND OF THE INVENTION

Face masks are widely worn by a healthcare professional, industrial personnel and general public. During breathing process, face mask helps to filter out air born particles, fumes, bacteria and viruses. Surgical face masks cover oral and nasal cavities of a wearer. Topography of nose prevents face mask to make a firm seal with the face. Usually, a lot of air leaks around the surgical face mask. Present invention discloses a wearable device over surgical face mask to enhance the sealing of mask to face.

BRIEF SUMMARY OF THE INVENTION

The present invention disclosed herein comprises of a gripping device and method of fabrication. Gripper is worn over a surgical face mask in order to restrict air from leaking around the mask. Dome shaped body of the gripper is fabricated from a rigid or semi-rigid material. Gripper edges are shaped to contoured the apex and ala of nose, cheek and the oral cavity. A dome shaped gripper structure held in place securely with elastic straps going around the ears or head and neck. Force generated by the stiffness in straps is transferred to the circumference of the gripper which in turn seals the surgical mask firmly to face. Gripper does not contact the face skin directly thus resulting in no skin pinching or discomfort. Firm seal produced by the gripper, forces air exchange through the mask filter during breathing process. Furthermore, firm seal eliminates the moist air escaping underneath top edge of the mask and condensing on the safety glasses.

DETAILED DESCRIPTION OF THE INVENTION

Figure 1:
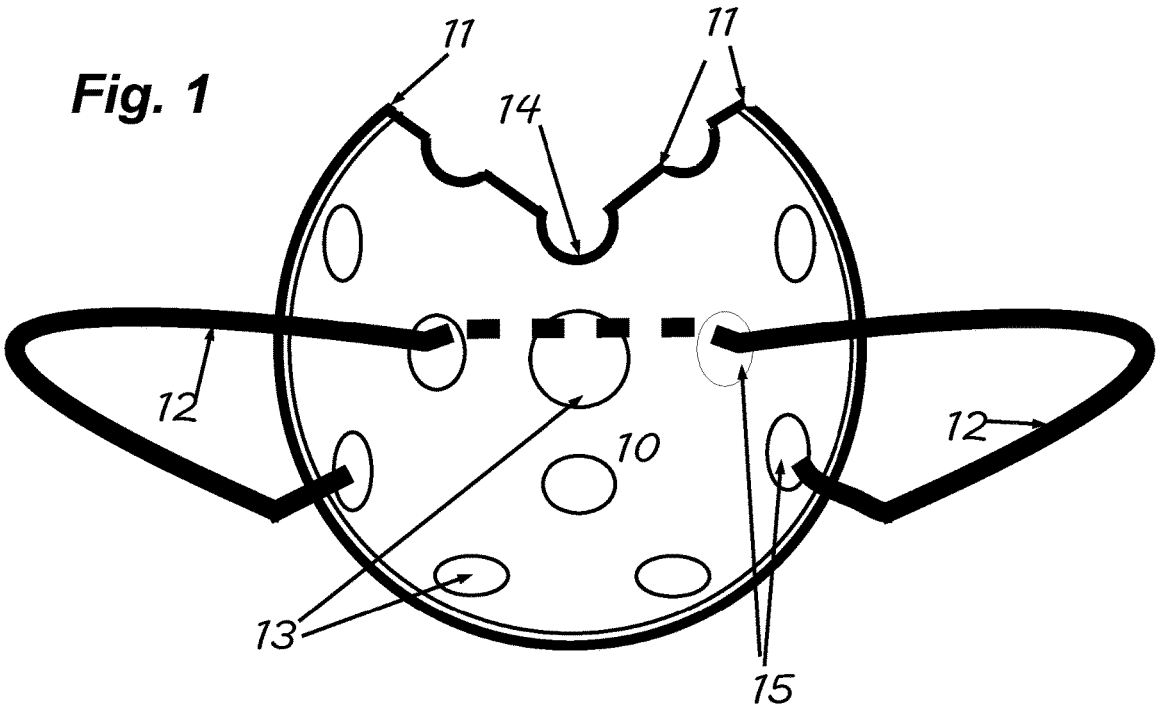
FIG. 1 is a front view of the gripper.

Following is the detailed description of the preferred embodiment. Referring generally to FIG. 1. 10 is the dome shaped shell structure. A "V" shaped section of dome is cut out. 14 is shaped to cover contour of nose apex and ala. Edges are formed in "V" section of dome. 11 depict the plurality of edges to grab and stretch the surgical mask. The dome shaped structure can be build from any rigid or semi-rigid material. 13 illustrate a vent hole for air exchange. Dome shaped structure 10 may have plurality of vent holes 13. 15 depicts the plurality of slots for tying the ends of gripper straps 12.

Figure 2:
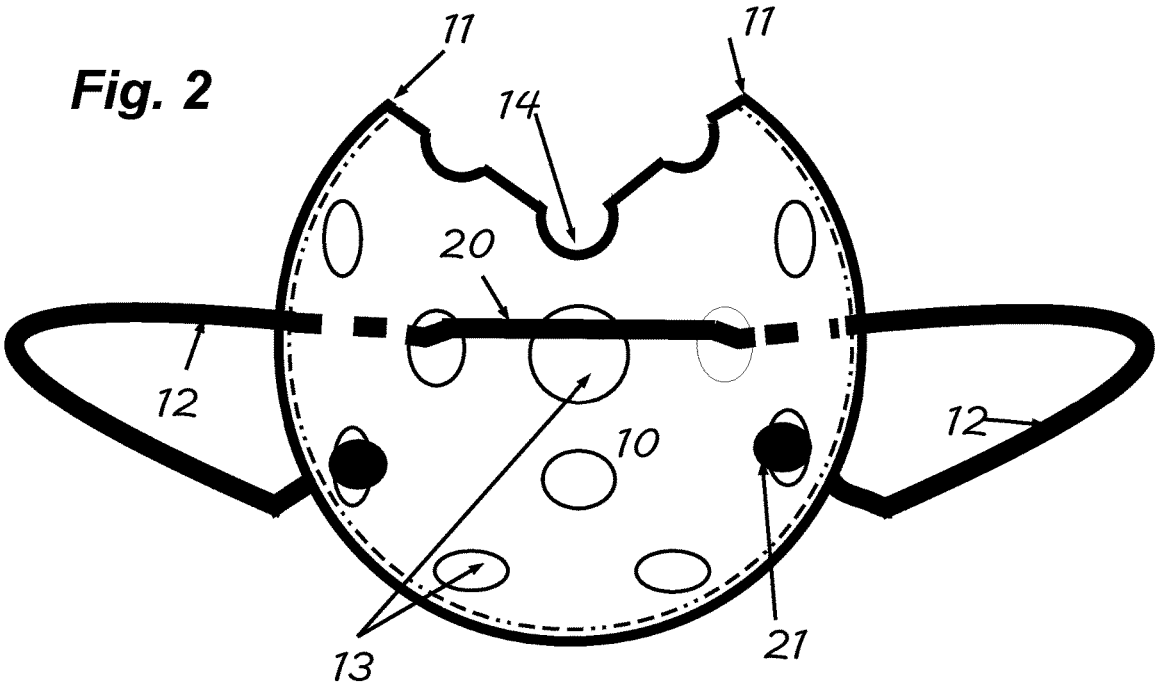
FIG. 2 is a back view of the gripper.
Figure 3:
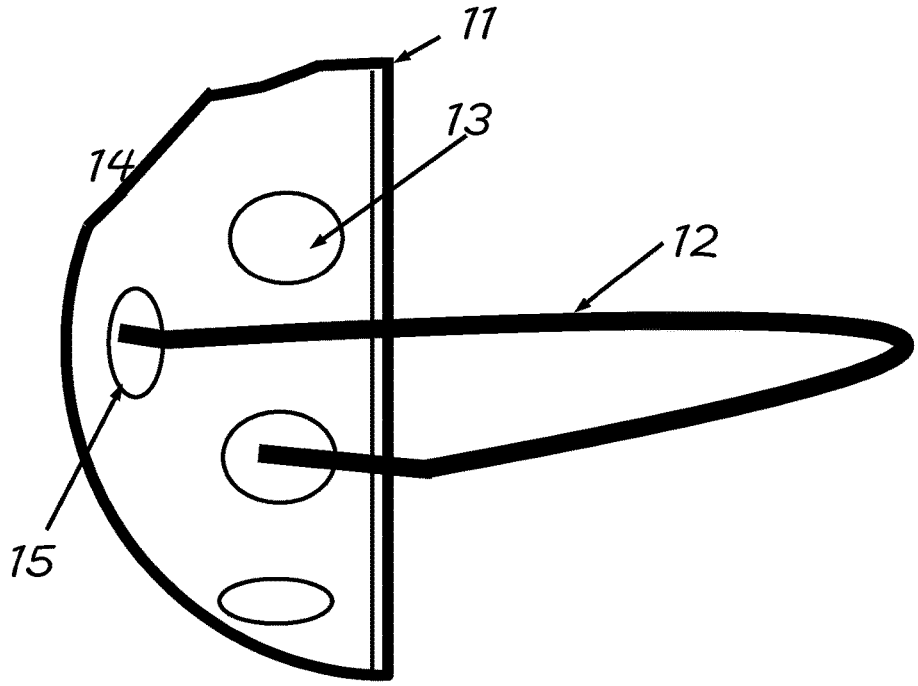
FIG. 3 is a side view of the gripper.

As illustrated in FIG. 2, gripper strap 12 is fully or partly made of elastic material. Terminals 21 of gripper strap 12 are glued, fasten or knotted to the dome structure 10.

Figure 4:
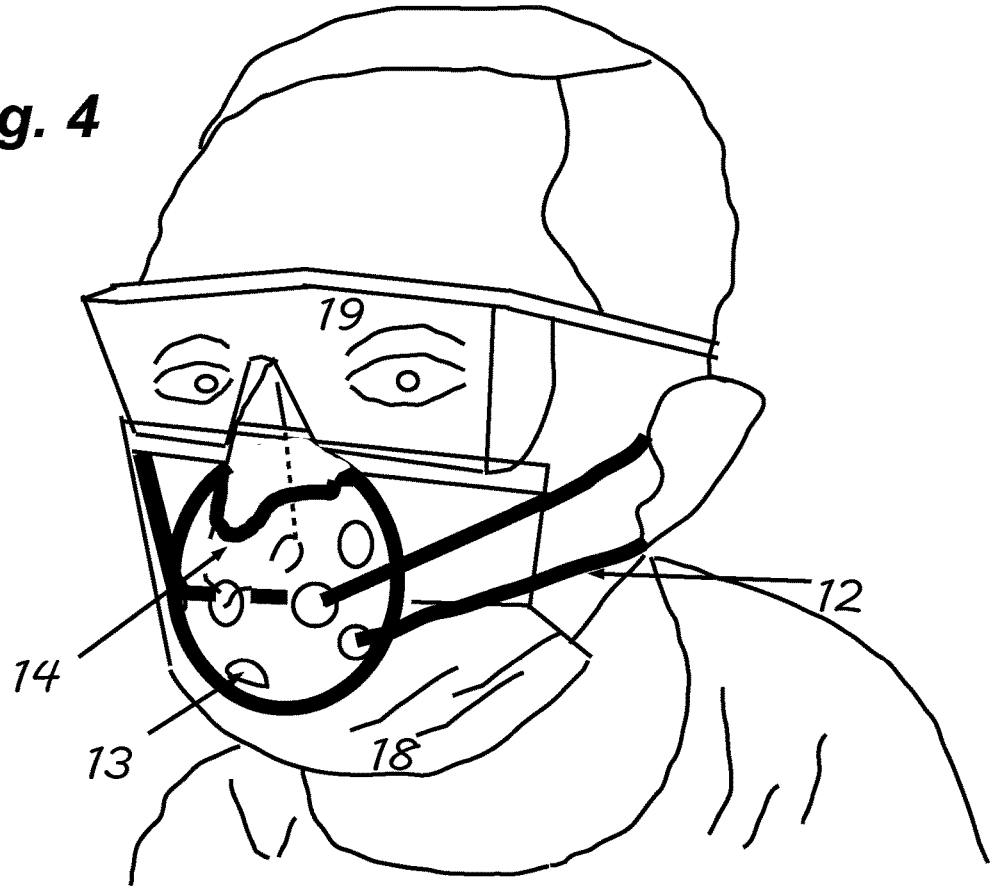
FIG. 4 is a perspective view of present invention when worn by a person.

When a person wears a gripper over a surgical mask 18 as illustrated in FIG. 4, section 20 of strap in FIG. 2 snuggles with nose columella. Tension in the strap cause a dome to press against the mask. Edges 11 and section 20 self-adjust to provide a firm seal. Low profile of gripper around nose facilitate wearing of safety and eye glasses 19 without any interference.

It will be understood that the foregoing description is of a preferred exemplary embodiment of this invention. This invention is not limited to the specific forms shown. For example, a variety of geometrical shapes such as conical or cylindrical can be used to fabricate 10. One large vent hole can be used instead of multiple smaller holes. Additionally, strap 12 can be designed to go around ears or head and neck or just one strap with loops at the ends.

The invention claimed is:

1. A gripper to be worn over a surgical face mask by a person comprising a rigid dome shaped shell structure having a "V" shaped section cut out and configured to cover the contours of nose apex, nose ala, cheek and oral cavity of a wearer, and a plurality of edges along the "V" shaped section cut out of said dome shaped shell structure for grabbing and stretching the surgical face mask section covering the nose, and a plurality of vent and strap tying holes in said dome shell shape structure, and a plurality of elastic straps with a section of said elastic strap passing through said dome shaped shell structure and going over the surgical face mask section in proximity of the nose columella.

2. A gripper as recited in claim 1 to be worn over a surgical face mask by a person to improve air filtering efficiency.

3. A gripper as recited in claim 1 to be worn over a surgical face mask by a person to minimize the fogging of safety and eye glasses.

* * * * *